US010252886B2

(12) United States Patent
Fernandez et al.

(10) Patent No.: US 10,252,886 B2
(45) Date of Patent: Apr. 9, 2019

(54) COMBINED GUIDE RAIL FOR AN ELEVATOR SYSTEM

(71) Applicant: Otis Elevator Company, Farmington, CT (US)

(72) Inventors: Juan Jose Fernandez, Madrid (ES); Andres Monzon, Madrid (ES); Francisco Luis Sanz, Madrid (ES); Santiago Gil, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 14 days.

(21) Appl. No.: 15/116,292

(22) PCT Filed: Feb. 4, 2014

(86) PCT No.: PCT/ES2014/070081
§ 371 (c)(1),
(2) Date: Aug. 3, 2016

(87) PCT Pub. No.: WO2015/118188
PCT Pub. Date: Aug. 13, 2015

(65) Prior Publication Data

US 2017/0008733 A1 Jan. 12, 2017

(51) Int. Cl.
*B66B 7/02* (2006.01)
*B66B 9/00* (2006.01)

(52) U.S. Cl.
CPC ..... *B66B 7/022* (2013.01); *B66B 7/026* (2013.01); *B66B 9/00* (2013.01)

(58) Field of Classification Search
CPC ..... B66B 7/022; B66B 7/026
See application file for complete search history.

(56) References Cited

U.S. PATENT DOCUMENTS 1,814,610 A 7/1931 Stevelman
6,012,554 A * 1/2000 Ito ..... B66B 7/022 187/406
2006/0260878 A1 11/2006 Hashiguchi
(Continued)

FOREIGN PATENT DOCUMENTS

CN 1802307 A 7/2006
CN 102892700 A 1/2013
DE 4423412 A1 4/1996
(Continued)

OTHER PUBLICATIONS

PCT International Search Report and Written Opinion; Application No. PCT/ES2014/070081; dated Mar. 11, 2014; 10 pages.
(Continued)

*Primary Examiner* — Diem M Tran
(74) *Attorney, Agent, or Firm* — Cantor Colburn LLP

(57) ABSTRACT

A combined guide rail for an elevator system includes a car guide rail portion to guide an elevator car along an elevator car travel path and a counterweight guide rail portion to guide a counterweight of the elevator system along a counterweight travel path. A connecting portion extends from the car guide rail portion to the counterweight guide rail portion. The car guide rail portion, the counterweight guide rail portion and the connecting portion are formed together as a single unitary structure from a single piece of material.

17 Claims, 5 Drawing Sheets

(56) References Cited

U.S. PATENT DOCUMENTS

| | | | | | |
|---|---|---|---|---|---|
| 2013/0062147 | A1* | | 3/2013 | Piech | B66B 7/022<br>187/359 |

FOREIGN PATENT DOCUMENTS

| | | | | | |
|---|---|---|---|---|---|
| JP | 1087223 | A | | 4/1998 | |
| JP | 10087203 | A | * | 4/1998 | B66B 7/022 |
| JP | 10139305 | A | * | 5/1998 | B66B 7/022 |
| JP | 11209029 | A | * | 8/1999 | B66B 7/022 |
| WO | 0222485 | A1 | | 3/2002 | |

OTHER PUBLICATIONS

Chinese Office Action Issued in CN Application No. 201480074918.9, dated Feb. 9, 2018, 6 Pages.

* cited by examiner

COMBINED GUIDE RAIL FOR AN ELEVATOR SYSTEM

CROSS REFERENCE TO RELATED APPLICATIONS

This application claims priority to PCT Patent Application No. PCT/ES2014/070081 filed Feb. 4, 2014, the entire contents of which is incorporated herein by reference.

BACKGROUND

The subject matter disclosed herein generally relates to elevator systems. More specifically, the subject disclosure relates to guide rails used in elevator systems for elevator cars and counterweights.

Elevator systems typically include an elevator car suspended in a hoistway by a number of suspension ropes or belts, and a counterweight suspended by the ropes or belts to balance the elevator system. The counterweight and elevator car each are guided by guide rails fixed in the hoistway.

The elevator car is connected to the car guide rails via one or more car guide shoes such that the elevator car follows a path defined by the car guide rails as it moves through the hoistway. Further, in some elevator systems, an emergency braking mechanism connected to the elevator car acts on the car guide rails to slow and/or stop the elevator car in the hoistway. Similarly, the counterweight includes one or more counterweight guide shoes to guide the counterweight along a path defined by the counterweight guide rails.

The typical car guide rail is a solid steel T-shaped rail. Such rail configurations are typically utilized because of their ability to withstand buckling and deflection during normal elevator operations and to withstand and loads applied during emergency braking. The typical car guide rails, however, are heavy and bulky, with each rail typically weighing 8 kilograms or more per meter and are typically installed in sections of 5 meters in length. Further, the amount of material used to form the rail drives the rail cost upward.

Sheet metal rails require less material and thus are less costly and lighter weight than traditional solid steel rail. Such rails have been utilized as counterweight guide rails, but not as elevator car guide rails because of the failure of such rail configurations to have the required torsional stiffness and crush resistance during operation of the elevator system and during emergency braking of the elevator car.

BRIEF DESCRIPTION

In one embodiment, a combined guide rail for an elevator system includes a car guide rail portion to guide an elevator car along an elevator car travel path and a counterweight guide rail portion to guide a counterweight of the elevator system along a counterweight travel path. A connecting portion extends from the car guide rail portion to the counterweight guide rail portion. The car guide rail portion, the counterweight guide rail portion and the connecting portion are formed together as a single unitary structure from a single piece of material.

Additionally or alternatively, the material is a sheet metal material.

Additionally or alternatively, the car guide rail portion includes a car guide portion extending from a car base portion.

Additionally or alternatively, the car base portion has a triangular cross-section.

Additionally or alternatively, the counterweight guide rail portion includes a counterweight guide portion extending from a counterweight base portion.

Additionally or alternatively, the counterweight base portion has a triangular cross-section.

Additionally or alternatively, a plurality of combined guide rail segments are arranged end to end, each guide rail segment formed from a single piece of material.

In another embodiment, an elevator system includes an elevator car positioned in a hoistway, and a counterweight positioned in the hoistway and operably connected to the elevator car. A combined guide rail is located in the hoistway and includes a car guide rail portion interactive with the elevator car to guide the elevator car along an elevator car travel path, and a counterweight guide rail portion interactive with the counterweight to guide the counterweight along a counterweight travel path. A connecting portion extends from the car guide rail portion to the counterweight guide rail portion. The car guide rail portion, the counterweight guide rail portion and the connecting portion are formed together as a single unitary structure from a single piece of material.

Additionally or alternatively, the material is a sheet metal material.

Additionally or alternatively, the car guide rail portion includes a car guide portion extending from a car base portion.

Additionally or alternatively, the car base portion has a triangular cross-section.

Additionally or alternatively, the counterweight guide rail portion includes a counterweight guide portion extending from a counterweight base portion.

Additionally or alternatively, the counterweight base portion has a triangular cross-section.

Additionally or alternatively, a plurality of combined guide rail segments are arranged end to end, each guide rail segment formed from a single piece of material.

Additionally or alternatively, the guide rail segments are aligned with each other via one or more guide brackets at least partially inserted into adjacent car guide rail portions and/or counterweight guide rail portions of the adjacent guide rail segments.

Additionally or alternatively, the one or more guide brackets are positioned in a base portion of the car guide rail portion and/or the counterweight guide rail portion.

Additionally or alternatively, one or more a rail plates span adjacent car guide rail portions and secure a first car guide rail portion of a first guide rail segment to a second car guide rail portion of a second guide rail segment.

Additionally or alternatively, the combined guide rail is secured to a wall of the hoistway.

Additionally or alternatively, the combined guide rail is secured to the wall of the hoistway via one of more fishplates.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
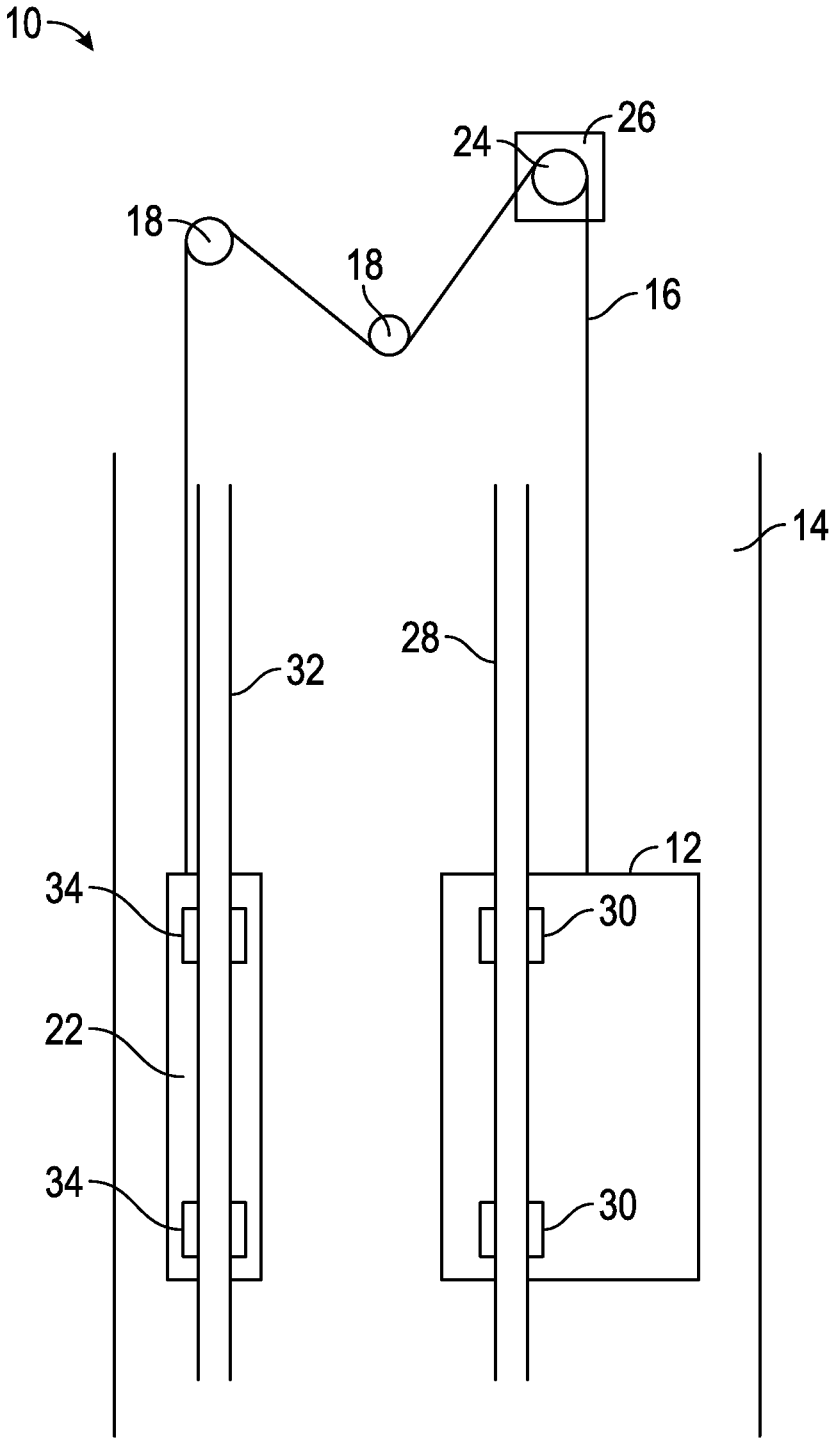
FIG. 1 is a schematic view of an embodiment of an elevator system.

Shown in FIG. 1 is a schematic of an exemplary traction elevator system 10. Features of the elevator system 10 that are not required for an understanding of the present invention are not discussed herein. The elevator system 10 includes an elevator car 12 operatively suspended or supported in a hoistway 14 with one or more drive members 16, such as ropes or belts. The drive members 16 interact with one or more sheaves 18 to be routed around various components of the elevator system 10. One of the sheaves may be a traction sheave 24 driven by a machine 26 to raise and lower the elevator car 12 in the hoistway 14. The drive members 16 are also be connected to a counterweight 22, which is used to help balance the elevator system 10 and reduce the difference in belt tension on both sides of the traction sheave during operation. While an elevator system 10 having a 1:1 roping arrangement, elevator systems having other roping arrangements, such as a 2:1 roping arrangements, will benefit from this invention.

To guide movement of the elevator car 12 along the hoistway 14, one or more car guide rails 28 are fixed in the hoistway 14. The car guide rails 28 define a travel path for the elevator car 12 in the hoistway 14 and may be utilized in conjunction with other components, such as elevator safety brakes (not shown) to stop movement of the elevator car 12. The elevator car 12 includes one or more car guide shoes 30, in some embodiments two car guide shoes 30 at each car guide rail 28, which interface with the car guide rail 28.

Similarly, one or more counterweight guide rails 32 are fixed in the hoistway 14, to define a travel path of the counterweight 22 along the hoistway 14. The counterweight 22 includes one or more counterweight guide shoes 34, in some embodiments two counterweight guide shoes 34 at each counterweight guide rail 32, which interface with the counterweight guide rail 32.

Figure 2:
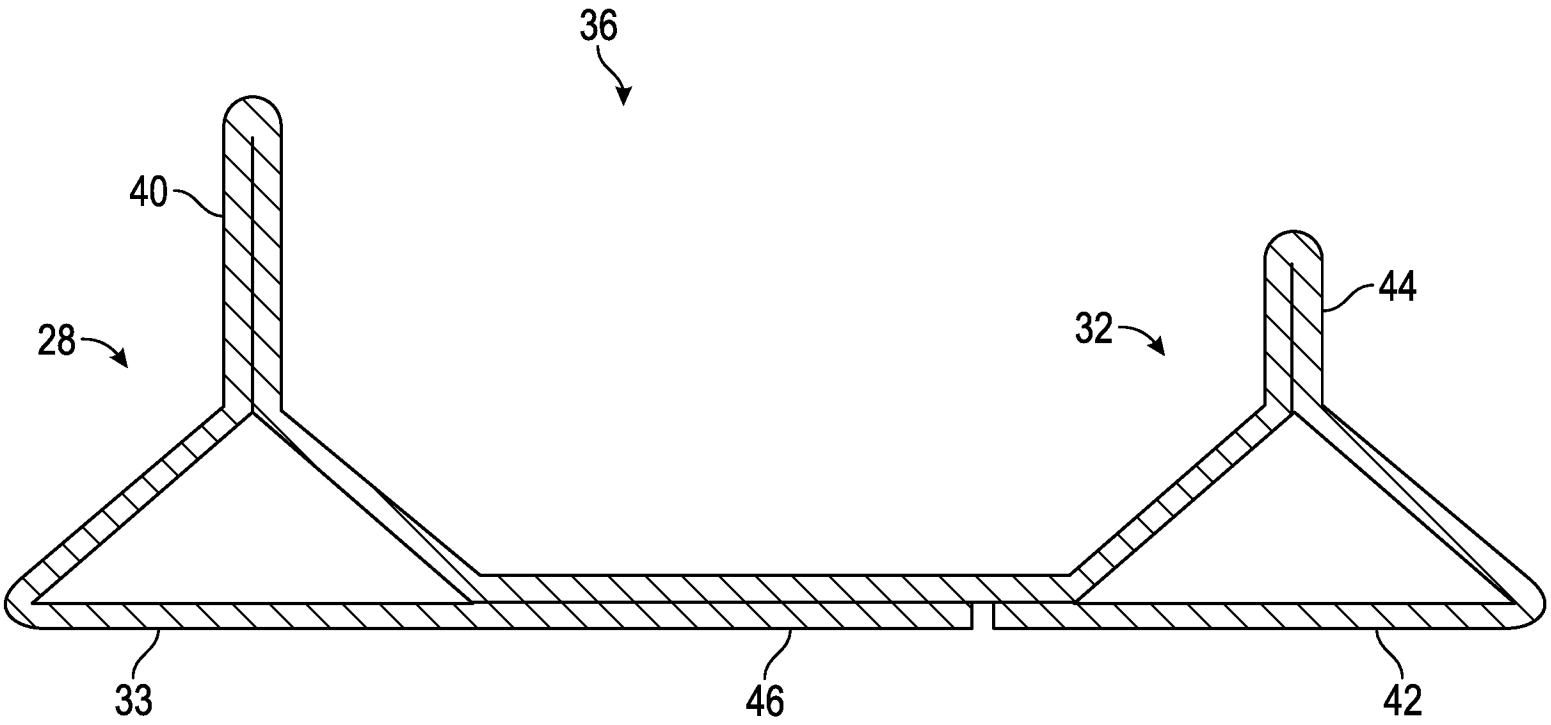
FIG. 2 is a cross-sectional view of an embodiment of a combined guide rail for an elevator system.

Referring to FIG. 2, the car guide rail 28 and counterweight guide rail 32 are formed as a combined guide rail 36 from a single piece of material, such as sheet metal. The combined guide rail 36 includes the car guide rail 28 having a car base portion 38 and a car guide portion 40, and the counterweight guide rail 32 having a counterweight base portion 42 and a counterweight guide portion 44. A connecting portion 46 connects the car base portion 38 to the counterweight base portion 42. The base portions 38, 42 are, for example, triangular in cross-section to improve stiffness of the car guide rail 28 and the counterweight guide rail 32. The car guide portion 40 and the counterweight guide portion 44 interface with the car guide shoes 30 and the counterweight guide shoes 34, respectively. As stated, the entire combined guide rail 36 is formed from a single continuous piece of material.

Figure 3:
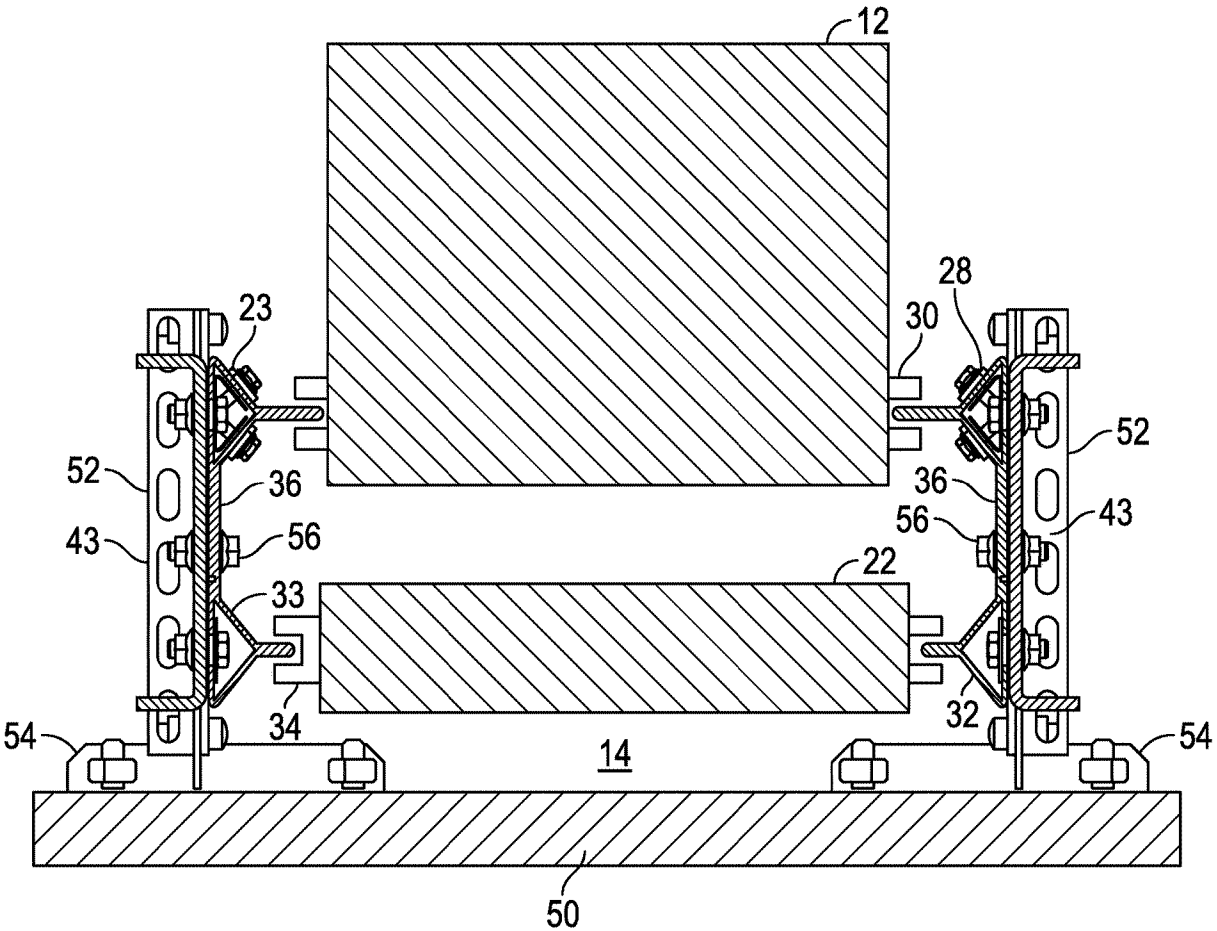
FIG. 3 is a cross-sectional view of an embodiment of an elevator system.

The combined guide rail 36 is secured in the hoistway 14, either directly or via a bracket assembly 48 such as that shown in FIG. 3. The embodiment of FIG. 3 illustrates a cantilevered elevator system 10, where the combined guide rail 36 is supported at one wall 50 of the hoistway 14. The combined guide rail 36 is secured to a fishplate 52 via one or more bolts 56, which in turn is secured to a mounting bracket 54. The mounting bracket 54 is secured to the wall 50.

Figure 4:
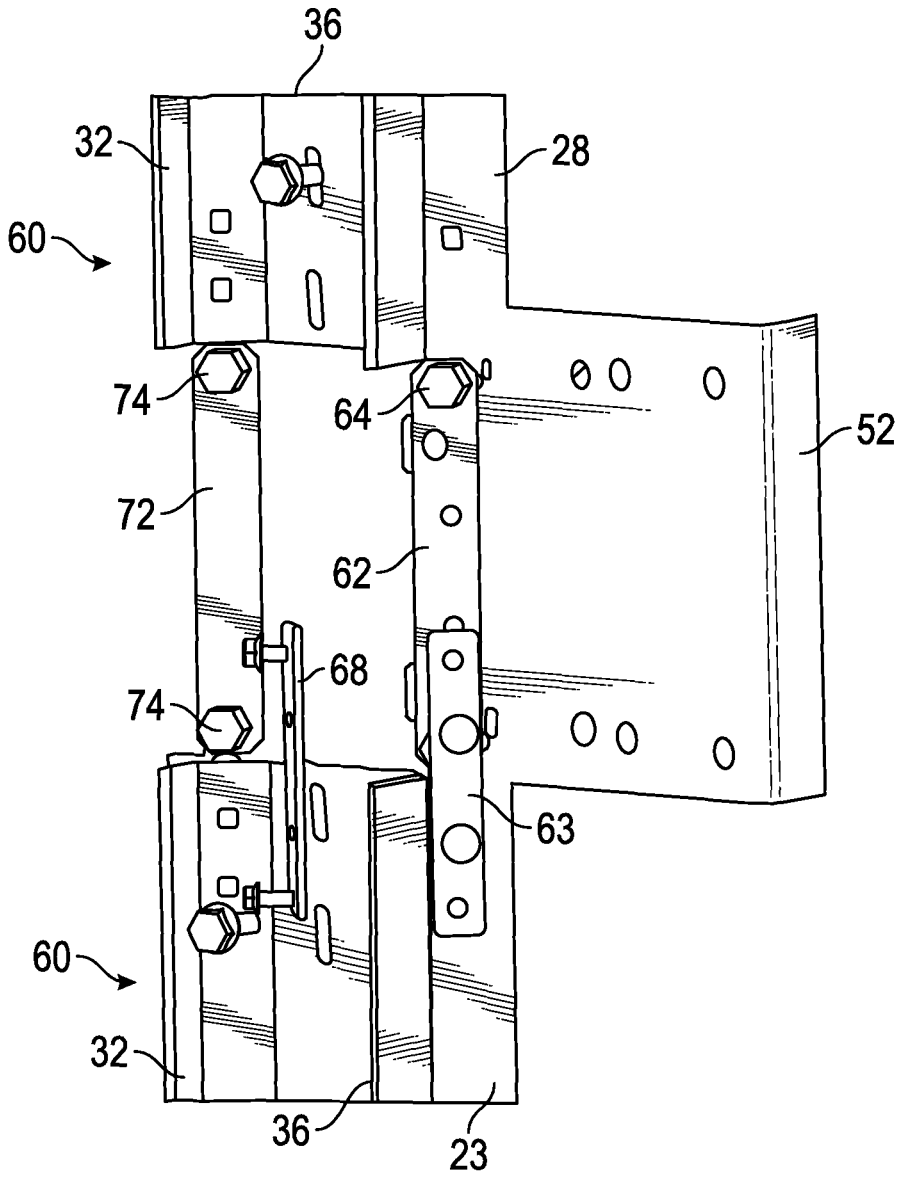
FIG. 4 is a schematic view of an embodiment of an attachment of adjacent guide rail segments.
Figure 5:
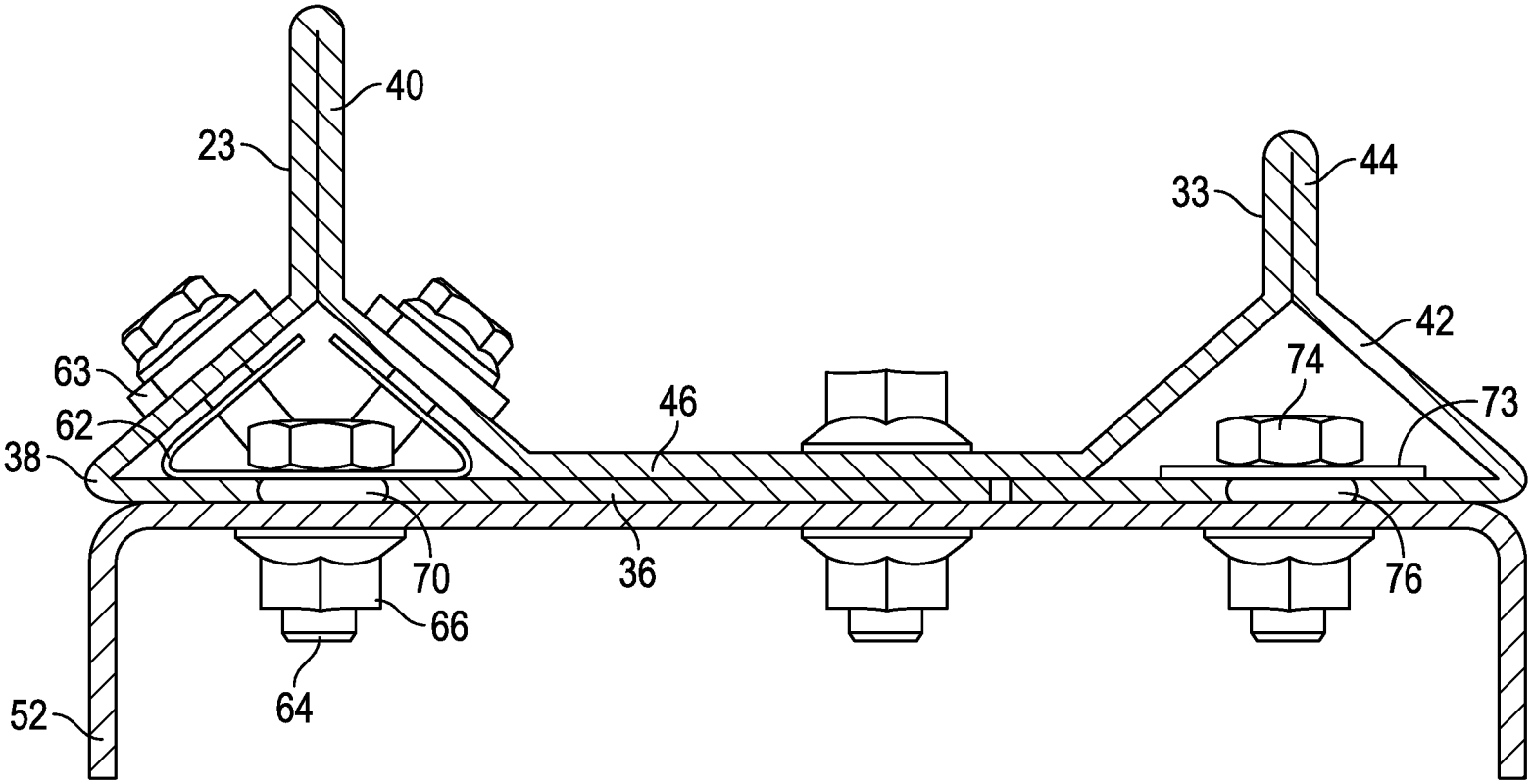
FIG. 5 is a cross-sectional view of an attachment of a combined guide rail to a fish plate.

As shown in FIGS. 4 and 5, the combined guide rail 36 is formed in rail sections 60, such that joining rail sections 60 end to end forms the combined guide rail 36 extending along the length of the hoistway 14. To align and join the rail sections 60 to one another, a car guide bracket 62 is inserted into the car base portions 38 of a first rail section 60 and of an adjacent second rail section 60 to align the car guide portions 40 of the rail sections 60. The car guide bracket 62 includes car guide bolts 64 extending from the car guide bracket 62, through the car base portion 40 and further through the fishplate 52 where a nut 66 is installed on each car guide bolt 64. In some embodiments, the car guide bolts 64 are secured to the car guide bracket 62 by, for example, welding, and installed into the rail sections 60 by guiding the car guide bolts 64 into slots 70 in the car base portion 40. In some embodiments, the car guide bracket 62 has a triangular cross-section matching that of the car base portion 40 to improve alignment of the rail sections 60 and also to structurally reinforce the car base portions 40. The rail sections 60 are further secured to one another via a rail plate 68 spanning from the first rail section 60 to the second rail section 60 and secured to both.

Similarly, a counterweight guide bracket 72 is inserted into counterweight base portions 42 of the first rail section 60 and of the adjacent second rail section 60 to align the counterweight guide portions 44 of the rail sections 60. The counterweight guide bracket 72 includes counterweight guide bolts 74 extending from the counterweight guide bracket 72, through the counterweight base portion 42 and further through the fishplate 52 where a nut 66 is installed on each counterweight guide bolt 74. In some embodiments, the counterweight guide bolts 74 are secured to the counterweight guide bracket 72 by, for example, welding, and installed into the rail sections 60 by guiding the counterweight guide bolts 74 into slots 76 in the counterweight base portion 42.

The combined guide rail 36 disclosed herein combines the car guide rail 26 with the counterweight guide rail 32 into a unitary element thus reducing the number of parts to be installed in the hoistway 14. Further, the sheet metal construction of the combined guide rail 36 reduces cost and weight of the guide rail system, thus reducing installation time and cost.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combined guide rail for an elevator system comprising:

a car guide rail portion to guide an elevator car along an elevator car travel path;

a counterweight guide rail portion to guide a counterweight along a counterweight travel path; and a connecting portion extending from the car guide rail portion to the counterweight guide rail portion;

wherein the car guide rail portion, the counterweight guide rail portion and the connecting portion are formed as a unitary structure from a single piece of material;

wherein the material is a sheet metal material; and wherein the connecting portion is formed from two thicknesses of the sheet metal material.

2. The combined guide rail of claim 1, wherein the car guide rail portion includes a car guide portion extending from a car base portion.

3. The combined guide rail of claim 2, wherein the car base portion has a triangular cross-section.

4. The combined guide rail of claim 1, wherein the counterweight guide rail portion includes a counterweight guide portion extending from a counterweight base portion.

5. The combined guide rail of claim 4, wherein the counterweight base portion has a triangular cross-section.

6. The combined guide rail of claim 1, further comprising a plurality of combined guide rail segments arranged end to end, each guide rail segment formed from a single piece of material.

7. An elevator system comprising:

an elevator car disposed in a hoistway;

a counterweight disposed in the hoistway and operably connected to the elevator car; and a combined guide rail disposed in the hoistway including:

a car guide rail portion interactive with the elevator car to guide the elevator car along an elevator car travel path;

a counterweight guide rail portion interactive with the counterweight to guide the counterweight along a counterweight travel path; and a connecting portion extending from the car guide rail portion to the counterweight guide rail portion;

wherein the car guide rail portion, the counterweight guide rail portion and the connecting portion are formed as a unitary structure from a single piece of material;

wherein the material is a sheet metal material; and wherein the connecting portion is formed from two thicknesses of the sheet metal material.

8. The elevator system of claim 7, wherein the car guide rail portion includes a car guide portion extending from a car base portion.

9. The elevator system of claim 8, wherein the car base portion has a triangular cross-section.

10. The elevator system of claim 7, wherein the counterweight guide rail portion includes a counterweight guide portion extending from a counterweight base portion.

11. The elevator system of claim 10, wherein the counterweight base portion has a triangular cross-section.

12. The elevator system of claim 7, further comprising a plurality of combined guide rail segments arranged end to end, each guide rail segment formed from a single piece of material.

13. The elevator system of claim 12, wherein guide rail segments are aligned with each other via one or more guide brackets at least partially inserted into one or more of adjacent car guide rail portions or adjacent counterweight guide rail portions of the adjacent guide rail segments.

14. The elevator system of claim 13, wherein the one or more guide brackets are positioned in a base portion of one or more of the car guide rail portion or the counterweight guide rail portion.

15. The elevator system of claim 12, further comprising one or more a rail plates spanning adjacent car guide rail portions and securing a first car guide rail portion of a first guide rail segment to a second car guide rail portion of a second guide rail segment.

16. The elevator system of claim 7, wherein the combined guide rail is secured to a wall of the hoistway.

17. The elevator system of claim 16, wherein the combined guide rail is secured to the wall of the hoistway via one of more fishplates.

* * * * *